US006877547B2

(12) United States Patent
Kawakita

(10) Patent No.: US 6,877,547 B2
(45) Date of Patent: Apr. 12, 2005

(54) HIGH PRIVACY HORIZONTAL WINDOW BLIND HAVING SLATS WITH NO CORD HOLES AND A SPECIAL CLIP

(76) Inventor: Kevin Kawakita, 5812 Temple City Bl. #100, Temple City, CA (US) 91780

( * ) Notice: Subject to any disclaimer, the term of this patent is extended or adjusted under 35 U.S.C. 154(b) by 0 days.

(21) Appl. No.: 09/974,265

(22) Filed: Oct. 9, 2001

(65) Prior Publication Data

US 2002/0050326 A1 May 2, 2002

Related U.S. Application Data

(60) Provisional application No. 60/244,034, filed on Oct. 27, 2000.

(51) Int. Cl.[7] ..... E06B 9/30

(52) U.S. Cl. ..... 160/168.1 R; 160/40; 160/178.3

(58) Field of Search ..... 160/176.1 R, 178.1 R, 160/168.1 R, 170 R, 171 R, 172 R, 173 R, 177 R, 178.3 R

(56) References Cited

U.S. PATENT DOCUMENTS

| | | | | |
|---|---|---|---|---|
| 1,327,363 | A | | 1/1920 | Wilson |
| 1,810,771 | A | * | 6/1931 | Krueger |
| 2,037,393 | A | | 4/1936 | Roberts |
| 2,152,117 | A | * | 3/1939 | Wade et al. |
| 2,200,349 | A | | 5/1940 | Walker |
| 2,532,617 | A | | 12/1950 | Hauser et al. |
| 2,565,840 | A | | 8/1951 | Clark |
| 2,662,593 | A | | 12/1953 | Walker |
| 3,086,586 | A | | 4/1963 | Wolfe |
| 4,341,254 | A | | 7/1982 | Schaller |
| 4,458,740 | A | | 7/1984 | Anderson |
| 4,553,580 | A | * | 11/1985 | Christoffersson |
| 4,763,713 | A | | 8/1988 | Kraus |
| 4,951,729 | A | | 8/1990 | Yu |
| 5,386,867 | A | | 2/1995 | Chen |
| 5,573,051 | A | | 11/1996 | Judkins |
| 5,582,226 | A | | 12/1996 | Voss |
| 5,769,140 | A | | 6/1998 | Tuzmen |
| 5,845,694 | A | | 12/1998 | Cohen |
| 5,918,657 | A | | 7/1999 | Tuzman |

* cited by examiner

*Primary Examiner*—Blair M. Johnson

(57) ABSTRACT

FIG. 4 is an overall view of the representation of the peeping tom (916) problem and its deterrence showing the peeping tom, factory made deterrent design for horizontal window blinds of the present invention (100) installed, and when the control cord hole free window blind slats (156) are fully tilt closed and fully lowered close, will prevent the peeping tom (916) from gazing through the control cord hole free window blind slats (156), furthermore, the left edge cover strip (140), and the right edge cover strip (144) prevent the peeping tom (916) from gazing around the window casing right side (900) and window casing left side (904) which are shown in relation to the window casing top (908) and the window casing bottom (912), furthermore, the clip (104) with a front loop (108) and a rear loop (116) and a window blind tilt control cord pair knot (196), plus snap tap holes (106) are shown on the clip (104), furthermore, the window blind raising open and lowering close control cord pair (160) and the window blind tilt control cord pair (164) are shown threaded through and attached to the clip loops in relation to the window blind head rail (168) and the window blind bottom board (172) and the raise open and lower close control cord pair user cord loops (180).

6 Claims, 5 Drawing Sheets

HIGH PRIVACY HORIZONTAL WINDOW BLIND HAVING SLATS WITH NO CORD HOLES AND A SPECIAL CLIP

REFERENCES—NON-PATENT LITERATURE REFERENCED

This application claims the benefit of Ser. No. 60/244,034 filed Oct. 27, 2000.

BACKGROUND—CROSS REFERENCE TO MY RELATED INVENTIONS

U.S. patent application Ser. No. No. 09,648,602, filed on Aug. 26, 2000 by Kawakita, Kevin.

This patent application concerns an add-on device which can be added to prior art horizontal window blind to prevent Peeping Tom activity. This device consists of specially designed clips, vertical slat cover strips, and two edge cover strip. This prior device is unlike the current patent, which concerns a design-in approach done at the factory.

BACKGROUND OF THE INVENTION

GENERAL INFORMATION OF PRIOR ART

FIELD OF THE INVENTION

The present invention relates generally to window coverings, and more specifically, to window blinds of the type having slats, control cords, and control cord holes in the slats. These types of window blinds usually allow a Peeping Tom to peer through the control cord holes even when the blinds are fully tilt closed and lowered closed. The problem is compounded when the window blinds are recessed within a window casing, creating gaps along the sides between the ends of slats and the window casing sides. Draperies can be used with blinds for high privacy, but, this defeats the purpose of using the blinds which is convenience and a dust resistant device.

General Description of the Prior Art

In public use and prior art are recent (year 1999) anti-Peeping Tom or high privacy horizontal window blinds of the type used by Hunter-Douglas (R), Ovation (R), and Levolor (R). These are described in detail below in relation to my invention.

There are various devices designed enhancing the general performance of window blinds having slats, such as venetian blinds which have existed since the 1800's. These included vertical, cloth strips and horizontal, cloth cord hole slat strips, which were sewn together in the form of a cloth ladder when viewed from the side of the blind which ladder performed the tilt open/tilt close operation. The tilt open/tilt close operation was done with a wood dowel in the headrail upon one end of the headrail was attached customer pull cords and upon which were stapled the, opposed, vertical, cloth strips. The raise open/lower close operation was performed by a cord which was threaded "free play" down the center width, hole with clearance in the slats and attached to the blind's bottom board. The raise open/lower close cords were attached to sets of double pulleys hidden in the headrail with the customer pulling the free hanging cords at one end of the headrail. These slats and various forms of tilt ladders and raise open/lower close cords were assembled at the factory, the slats were not removable, and the damaged or bent slats could not be retroactively replaced in existing window blinds. There was no edge gap protection in certain inside the window blind mountings allowing Peeping Tom access. The vertical, cloth strips covered the slat cord hole in the fully lowered close and tilt closed directions preventing Peeping Tom access. The Venetian blind headrail could be unscrewed to take the blinds out for light soap washing and spraying off. The Venetian blinds were effective at privacy, but, heavy and got dusty quite fast. Modern horizontal wood blinds trace their heritage to the old Venetian blinds.

The advent of the miniblinds pioneered by Levolor (R) occurred in the 1970's using very thin and concave, open face pointed down, aluminum slats. The miniblinds used a very thin, cord ladder for the tilt open/tilt close mechanism. The tilt cords were attached to "cord winches" strategically placed upon a plastic, horizontal, "tilt rod" in the headrail which acted like the old Venetian blind's wood, tilt dowel. Upon one end of the "tilt rod" was attached a differential gear which attached to a free hanging customer activated, rotary action, "tilt wand." The miniblinds used a raise open/lower close operation performed by a cord which was threaded "free play" down the center width hole with clearance of the slat and attached to the blind's bottom board. The raise open/lower close cords were attached to sets of double pulleys hidden in the headrail just like the old Venetian blinds, but, on a smaller scale. The customers pulled a set of "free hanging" raise open/lower close cords at one end of the headrail. Unlike the Venetian blind cloth ladder, the Peeping Tom's could peer through the miniblind's slat cord hole because the cord ladder did not cover the holes in the lowered close and tilt closed directions. The Peeping Tom's could also access the miniblind's two edge gaps formed with the window casing in certain blinds mountings done entirely inside of the window casing. The miniblinds were very mechanically efficient, inexpensive, and could be easily removed from the headrail without screwdrivers for light soap, washing and spraying.

Certain highly relevant patents have been selected out of all know prior art relevant patents for detailed discussion.

These U.S. patents in most cases concerned many different horizontal window blind devices using slats with no cord holes and some sort of tilt open/tilt close and or raise open/lower close mechanism. The object of these improvements were to:

1). increase privacy,

2). lower light leaks in fully lowered close and tilt closed blinds,

3). make single damaged slat changes easier,

4). make single stained, slat cleaning easier.

Some of these patents used specially designed slat clips and some used slats with specially shaped notches or edge notches. However, all of these prior art designs have some notable flaw which is not present in my present invention.

These are described in detail below in relation to my invention.

Specific Public Use in Prior Art

Levolor (R) "Ultra Dark" (R) Model

Levolor (R) has recently announced in 1999 its "Ultra Dark" series of horizontal miniblinds. These blinds have a very low light leak emphasis. The relevant, non-patented aspects of this model are that the raise open and lower close cords requiring a slat portion with cord holes are separated from the tilt open and tilt close cords which need a slat portion with-out cord holes for effective operation.

The raise open and lower close cords are placed alone as the two outermost columns of blind cord controls. These raise open/lower close cord controls require a center-width positioned, slat with cord hole to pass the raise open/lower close cord through in a "free play" manner which cords are firmly attached to the bottom board. These raise open/lower close cords also do not require a rope or cloth ladder attached to the head rail. In most small sized windows, the position of these two outermost columns is so near the edge of the window that the window casing or else the window frame projections cover any access to the slat cord holes by Peeping Toms. In large width windows, the position of the outermost columns must be moved towards the center of the window and more than two outermost columns might be used which re-introduces a Peeping Tom problem through the cord hole in the slat.

The inner columns of vertical, blind control cords are used only for the tilt open/tilt close cords. These tilt open/tilt close cords require a cord or cloth ladder to operate, but, do not require a slat cord hole. Eliminating the raise open/lower close cords from these center columns allows elimination of the accompanying slat cord holes only from the center columns. This factor reduces the light leak total which lends the "Ultra Dark" name. The center columns have no slat cord hole and thus have no Peeping Tom problem. The tilt close/tilt open operation works fully in both inner slat edge up and inner slat edge down positions from an inside the room view. This avoids the partial, inner slat edge up, tilt position problem of the Hunter-Douglas high privacy design mentioned below.

The Levolor (R) "Ultra Dark" horizontal window blinds still produce an edge gap between the blinds and the window casing in certain types of blind mountings known as "inside the window casing mountings". In this mounting, the blinds are fully inside of the window easing and hang down from the top edge of the window casing. This edge gap can be freely used by Peeping Toms.

The tilt open and tilt close operation is still initiated by a single, user operated tilt wand and internal to the headrail, tilt rod mechanism composed of a tilt rod which is attached to the tilt open/tilt close control cords through winches.

The raise open/lower close operation is still initiated by a user operated, single, free-hanging, control cord which is attached through internal to the headrail pulleys to the raise open/lower close blind cords.

The "Ultra Dark" model can optionally come absent of the user operated, single, free-hanging, raise open/lower close control cord. This is for child safety purposes to prevent accidental infant and pet strangulation. Infants and pets can accidentally strangle themselves on anything forming a rope noose. The free-hanging, raise open and lower close control cord is replaced by a US and foreign patented, spring-loaded, self-ratcheting, internal pulley. The user simply raises open and lower closes the bottom board of the blind by hand to activate the self-ratcheting pulley.

My invention avoids the slat cord hole problem altogether by eliminating it while allowing a full, tilt-close in either direction and also the ability to change individual bent or broken slats (children and pets bend and break slats all the time). Unlike this Levolor model, my invention also provides for an edge covering strip to cover edge gaps made with the window casing. My invention does not cover the child and pet accidental strangulation problem. However, a Levolor (R) like spring-loaded, self-ratcheting pulley can be used to replace the free-hanging, raise open/lower close control cord.

Public Domain Hi-Privacy Miniblind Design

Hunter Douglas (R), Ovation (R), and Levolor (R) have new (1999) anti-Peeping Tom or high privacy horizontal window blinds in the prior art and available for public use. These horizontal window miniblinds have a slat tilt axis off-center width on the horizontal slat allowing the slat center hole to be made much smaller for deterring Peeping Toms. The cord hole on the slat is placed slightly closer to the street facing, or outer side of the blind. Also in the tilt close directions, the slat overlaps the adjoining top or bottom slat's hole thus completely blocking through the cord hole Peeping Tom activity. In most high privacy designs, the tilt close operation only works fully in one direction as disclosed below with a partial tilt close in the other direction.

In prior art blinds, the slat center hole was usually oblong in shape to allow for raise open/lower close cord clearance during a tilt open/tilt close operation. The cord hole in the slat was also fully-center of width placed on the horizontal slat. The center of width cord hole position allowed for raise open and lower close cord clearance in either a full tilt open operation with room-facing or inner slat edge horizontal, a full tilt close operation with room-facing or inner slat edge down, or else a full tilt close operation with room-facing or inner slat edge up. This high clearance, oblong shape cord hole created the Peeping Tom problem.

All prior art blinds use curved slats with the curvature pointed face-down towards the floor. This shaping minimizes "light leaks" in a fully lowered close and tilt closed blind. This shaping also minimizes "stack height" which is the height of a fully tilt open and raised open blind.

During a full tilt close with room-facing or inner slat edge down operation when inside of the room, the Hunter-Douglas high privacy design needs much less raise open and lower close cord clearance around the off-center width, slat cord hole. This factor allows a much narrower and shorter slat cord hole shape. As well the off-center width position of the cord hole closer to the street, allows the cord hole to be completely covered by an upper slat during a full tilt close with inner slat edge down operation.

However, the off-center width position of the cord hole closer to the street, does NOT allow the cord hole to be completely covered by a lower slat during a full tilt close with inner slat edge up operation!!!!! What happens to prevent this is that the inner slat edge of the very top most slat hits the head rail and prevents full tilt closure only in this direction. The very bottom-most slat will also have its inside edge tilt up revealing a gap between the bottom board. A remedy to allow full tilt operation in either direction will have to fix these problems. This is a noted drawback which customers do not like in the Hunter-Douglas design!!!!!

The Hunter-Douglas horizontal window blind design can also be pictured as a sideways view of a rope ladder with the right side of the ladder facing the street. In viewing the cord mechanism from the side which looks like a rope ladder, the slat tilt axis is located closer to the right side or street side tilt open/tilt close control cord and not on the center width of the slat. The right side or street side tilt open/tilt close control cord is mostly stationary during a tilt operation with the left side or room side tilt open/tilt close control cord shifting position up and down. An additional center raise open/lower close control cord goes down the center of the ladder through the slat cord hole with "free play" on the slat and attaches on the bottom board. This is the cord which raises and lowers the blind. Slat clearance with this center raise open/lower close control cord during a tilt operation determines the shape and size of the slat cord hole.

This high privacy improvement is only available on Hunter Douglas blinds newly manufactured after 1999. This design is in the public domain and is used by several current blind manufacturers.

This design seems to be preceded by the Chen patent, U.S. Pat. No. 5,386,867 (see below) assigned to Care Mate (R) International Company, Ltd. Product markings for this patent do not occur.

The problem with this Hunter-Douglas design is that the blind will only fully, tilt close in one tilt direction and not the other tilt direction. The full close direction is an inside edge or room facing edge tilt down operation. This inside edge is the edge farthest away from the off-center, slat cord holes. The partial close direction is an inside edge tilt up operation when facing the blind from inside the room. The outside or street edge is the side closest to the off-center slat cord holes. Customers do not like this feature of this particular high privacy design.

My invention avoids the slat cord hole problem altogether by eliminating it while allowing a full, tilt-close in either direction and also the ability to change individual bent or broken slats (children and pets bend and break slats all the time). Unlike Hunter-Douglas, it also provides for an edge covering strip to cover edge gaps made with the window casing.

Specific Patented Use in Prior Art

U.S. Pat. No. 5,918,657

Inventor: Tuzmen, Zeki

Issued: Jul. 6, 1999

This second Tuzmen patent is a Continuation in Part (CIP) of her first Tuzmen US patent, U.S. Pat. No. 5,769,140 (see below). It covers a horizontal window blind having slats with no cord holes. The objective is to lower light leaks. No mention is made of Peeping Tom prevention, although her invention solves part of this problem. In the preferred embodiment, it consists of an open top, "C-shaped", metal clip held with the "C-shape" open face up towards the ceiling through which the cord hole free slat is slid horizontally through and across the clip. On the room facing front of the clip or front-side of the "C-shape" is loop attached a single metal ring which is threaded through a vertical, cloth, front, "tilt sleeve". On the street facing back of the clip or back-side of the "C-shape" is loop attached a single metal ring which is threaded through a vertical, cloth, back, "tilt sleeve". The cloth, "tilt sleeve" combined with the "C" clip provides the ladder mechanism for cord hole free slat retaining and the tilt open/tilt close operation. One or more vertical columns of these clips is used to hold all the horizontal slats on the window blind.

A vertical column of the street facing, back, "tilt sleeve" is threaded "free play" with a raise open/lower close blind cord which attaches to the bottom board. A vertical column of the room facing, front, "tilt sleeve" is also threaded "free play" with a second raise open and lower close blind cord which attaches to the bottom board.

In a secondary embodiment using the same "C-shaped" clips for cord hole free slats, the preferred embodiment does not use a "tilt sleeve." Instead, a vertical column of the street facing, back, metal rings is threaded with a tilt open/tilt close cord which is tied to each individual metal ring. A second metal ring is looped through the first metal ring. The second metal ring is threaded with a "free play" raise open/lower close cord. In a likewise manner, a vertical column of the room facing, front, metal rings is threaded with a tilt open/tilt close cord which is tied to each individual metal ring. A second metal ring is looped through the first metal ring. The second metal ring is threaded with a "free play" raise open/lower close cord.

This Continuation in Part Tuzmen patent unlike my invention has the problem of excessive light leaks in the fully lower closed and fully tilt closed operation. The "C-shaped" wire clip on the bottom of a concave, open face down, slat will prevent full flush across the slat contact with both upper and lower adjoining slats, tilt closure causing light leaks. The "C-shaped" wire clip can also cause greater "stack height" which is the height of the stacked, often concave-down, curved slats when the blind is fully tilt open and raise opened. "Stack height" can greatly increase using ill-designed clips with often concave-down, curved slats. Minimal stacking height allows the most amount of full sunlight and fresh air through the fully opened blind. The slats in this first Tuzmen patent might also get scratched by friction contact of metal clip upon aluminum slat. Edge gap protection when the blind is mounted inside of the window casing is also not covered by this patent.

U.S. Pat. No. 5,845,694

Inventor: Cohen, Leone A.

Issued: Dec. 8, 1998

This Cohen patent emphasizes an individual slat width adjustable system of horizontal window blinds whose main design emphasis is that it is adjustable to fit odd shaped windows such as arch shaped windows, round windows, triangular windows, etc. Each individual cord hole free slat is width adjustable through means of a full-length, slat carrier tray which holds overlapped blind slats. Decorative coverings can be placed on top of the slat carrier tray which holds each slat.

Each slat carrier tray has little eyelets attached on either side of the tray which are used for both a "free play" raise open and lower close cord and a "tied on" tile open/tilt close cord. In an alternative embodiment, the eyelets are replaced by cord holes made in the slat carrier tray and the slats.

This Cohen patent unlike my invention has the problem of excessive light leaks in the fully lower closed and fully tilt closed operation due to the eyelets. The full-length, slat carrier tray with eyelets on the sides prevents full tilt closure causing light leaks. The full-length, slat carrier tray can also cause greater "stack height" which is the height of the stacked slats when the blind is fully tilt open and raise opened. "Stack height" can greatly increase using ill-designed clips with often concave-down, curved slats. Minimal stacking height allows the most amount of full sunlight and fresh air through the fully opened blind. The extendible slats in this Cohen patent will also slip out of position causing uneven slats and a messy appearance. The alternative embodiment of the Cohen patent uses cord holes in the slats instead of protruding eyelets. This design also has light leak problems, Peeping Tom problems, U.S. Pat. No. 5,769,140

Inventor: Tuzmen, Zeki

Issued: June 1998

This first Tuzmen patent covers a horizontal window blind having slats with no cord holes. It has a Continuation in Part in U.S. Pat. No. 5,918,657 (see above) which more fully explains the details mentioned in this first patent.

U.S. Pat. No. 5,582,226

Inventor: Voss, Robert J., Valle G., Tuzmen, Zeki

Assigned to: Newell Operating Company (Now Newell/Levolor Corp.)

Issued: Dec. 10, 1996

This Voss patent covers a horizontal window blind having slats with no cord holes, but, with slat edge notches to retain the blind cords. It has an objective of lowering light leaks and allowing individual removal and replacement of broken slats. A "free play" raise open/lower close operation set of cords runs vertically down the slats with partial retaining by the slat edge notches. A rope ladder for tilt open/tilt close operation runs vertically down the slats with partial retaining by the slat edge notches. A prior art headrail mechanism is assumed for initiating tilt open/tilt close and raise open/lower close operations.

The Voss patent seems to be preceded by the very similar design of the Judkins patent (see below).

The Voss patent is now used commercially by Levolor in their "high privacy" wood blinds.

The problems with the Voss patent is that light leaks come in through the edge notches. Edge notches for cords can even be used for Peeping Tom activity. There is also no edge gap protection in certain blind mountings done all inside of the window casing.

U.S. Pat. No. 5,573,051

Inventor: Judkins, Ren

Issued: Nov. 12, 1996

This Judkins patent covers a horizontal window blind having slats with no cord holes, but, with slat edge notches to retain the blind cords. It has an objective of lowering light leaks and allowing individual removal and replacement of broken slats. A "free play" raise open/lower close operation set of cords runs vertically down the slats with partial retaining by the slat edge notches. A rope ladder for tilt open/tilt close operation runs vertically down the slats with partial retaining by the slat edge notches. Additional design occurs for a headrail mechanism consisting of tilt wand with tilt rod and wide, tilt winch mechanism with center threaded raise open/lower close cords.

The problems with the Judkins patent is that light leaks come in through the edge notches. Edge notches for cords can even be used for Peeping Tom activity. There is also no edge gap protection in certain blind mountings done all inside of the window casing.

U.S. Pat. No. 5,386,867

Inventor: Chen, Milton

Assigned to: Care Mate International Co, Ltd.

Taiching, Taiwan, Prov. of China

Issued: Feb. 7, 1995

Appears to be first U.S. patent registered miniblind use of the off-center slat hole very close to the street side for the "free play" raise open/lower close blind cord. The objective is to reduce light leaks in a fully lowered close and tilt closed blind. Anti-Peeping Tom activity is not mentioned, but, occurs. This Chen design allows use of a minimized slat cord hole because of greatly reduced hole to cord clearance in a raised open and fully tilt opened blind. In a room-facing, slat edge, tilt-down operation, the adjoining top slat will also overlap the then top moved, small cord hole of the slat of interest blocking both light leaks and Peeping Tom activity. The tilt operation in the other direction does not work, as mentioned below in problems.

Appears to be used in the Hunter Douglas, high privacy, Peeping Tom design (see above), but, US Patent markings as to this does not occur.

Appears to have taken the Yu patent design (see just below) and adapted it for use on blinds without needing a full-length, slat cloth sleeve.

The problems with the Chen patent are that full, tilt close of a fully, lowered close blind only occurs in one direction. As mentioned just above, the room-facing, tilt edge down operation fully tilt closes the slats. However, the room-facing, tilt edge up operation does not fully tilt close the slats. The topmost slat will hit the headrail causing a partial tilt up for all slats. The bottom-most slat will leave a gap with the bottom board. Customers do not like this limitation. The edge gap problem still occurs for certain blind mountings done entirely inside of the window casing.

U.S. Pat. No. 4,951,729

Inventor: Yu, Chi

Issued: Aug. 28, 1990

This Yu patent concerns a high privacy, horizontal window blind using a cord hole and edge notch free slat. However, it uses a special, full-length of slat, cloth sleeve, slat holder. The cloth sleeve, slat holder has a special hardened, edge added to the sleeve holding the slat. The special hardened, edge has an off center axis, small, slat cord hole which is on the street-facing, edge of the slat. The raise open/lower close "free play" cord is threaded down the slat cord hole. The tilt open/tilt close cords on either side of the slat are sewn attached to the cloth sleeve to form a ladder mechanism for tilt open and tilt close.

In a room-facing, slat edge, tilt-down operation, the adjoining top slat will also overlap the then top moved, small cord hole of the slat of interest blocking both light leaks and Peeping Tom activity. The tilt operation in the other direction does not work, as mentioned below in problems.

The problems with the Yu patent are that full, tilt close of a fully, lowered close blind only occurs in one direction. As mentioned just above, the room-facing, tilt edge down operation fully tilt closes the slats. However, the room-facing, tilt edge up operation does not fully tilt close the slats. The topmost slat will hit the headrail causing a partial tilt up for all slats. The bottom-most slat will leave a gap with the bottom board. Customers do not like this limitation. The edge gap problem still occurs for certain blind mountings done entirely inside of the window casing.

U.S. Pat. No. 4,763,713

Inventor: Kraus, Robert J.

Issued: Aug. 16, 1988

The Kraus patent is a horizontal window blind mechanism for an exterior storm window, or else a high security, anti-crime, window made of tiltable, steel panels or a lower security window made of tiltable, panes of glass. No cords are used and no ladder tilt assembly made of cords or cloth is used. A steel bar extends horizontally and length-wise across the center of each horizontal slat. The horizontal bar protrudes beyond the slat edges on either side with the protruding bar edges sliding up and down within vertical grooves placed on either side of the window blind casing. The horizontal bar also allows a pivoting action for each individual slat. The tilt open/tilt close action is introduced by towards the room, zigzagging, foldable cloth tapes individually attached to opposing sides of each solid slat. The top-most slat must be tilted room facing edge up to tilt all other slats room facing edge up via the two cloth tapes. The bottom-most slat must be tilted room facing edge down to tilt all other slats room facing edge down via the two sets of cloth tapes. The raise open operation is done by the user raising the bottom-most slat and piling up adjoining slats while the slats slide up the horizontal steel bar. The lower close operation is done by the user lowering the bottom-most slat and pulling the other slats down via the foldable cloth tapes while the slats slide down upon the horizontal metal bar.

The disadvantages of the Kraus patent are that no headrail mechanism for remote or motorized operation exists. The Kraus patent is also more suited to exterior of window protective use of large, stiff, slats made of steel or glass.

U.S. Pat. No. 4,458,740

Inventor: Anderson, Richard N.

Issued: Jul. 10, 1984

Assigned to: Hunter Douglas, Inc.

This Anderson patent covers a special type of vertical lever knob adjusted "memory" tilt assembly and pivoting bottom slat assembly. The use of the vertical lever knob with marked or ruled positions on the lever casing allows easy knob aided return to full tilt open and full tilt close or restoration of a particularly desired tilt setting. No separate headrail is used in the design and no separate bottom rail. Slats without cord holes, but, with notches are used. A rope ladder is used to hold the cord hole free slats by their notches. The rope ladder allows slat tilt open and tilt close, but, raise open and lower close of the slats is NOT supported.

This Anderson patent uses cord hole free slats. A solid, non-removable, strip on the two sides of the window frame is called a "front frame piece" which acts to slot restrain the slats and also functions on one side to have a vertical slot for the vertical knob adjusted "memory" tilt assembly. This "front frame piece" functions like a non-removable edge cover strip stopping edge "Peeping Tom" viewing action although it is not intended for this use. The notched slats without cord holes stop Peeping Tom action, but, allow light leaks. The lack of a raise open and lower close operation is a big disadvantage.

U.S. Pat. No. 4,341,254

Inventor: Schaller, Maurice et. al.

Assigned to: Levolor Lorentzen, Inc.

Issued: Jul. 27, 1982

The Schaller patent refers to a solid metal (such as aluminum), rectangular, accent frame for a horizontal window blind. The solid frame offers Peeping Tom edge protection although this Is not one of the stated objectives. A mechanism for frame construction with aluminum pieces is provided.

Disadvantages of the Schaller patent are that the color or decorative pattern of the frame is fairly permanent. This type of rectangular frame also works mostly for newly installed horizontal mini-blinds. My invention offers easily changeable colors and patterns for edge gap protection. My invention offers add-on edge gap protection for all types of window blinds including vertical window blinds and horizontal window blinds.

U.S. Pat. No. 3,086,586

Inventor: Wolfe

Issued: April 1963

This Wolfe patent concerns a horizontal window blind having slats with a "T-shaped" cord hole allowing individual slat removal and replacement or repair. It consists of a specially designed slat with a "T-shaped" slot with the base of the "T" open to the edge of the slat only on one edge and the bar of the "T" positioned in the center width of the slat. A standard, prior art, vertical, cloth ladder type slat holder is used for the tilt open and tilt close operation. A standard, prior art "free play" raise open and lower close control cord is threaded down the top middle bar of the "T" with attachment upon the bottom board.

This Wolfe patent unlike my invention has the problem of excessive light leaks in the fully lower closed and fully tilt closed operation. The cord hole slots and cord holes on the slat produce extra light leak areas. The Wolfe patent also still has Peeping Tom access through the slat cord holes, slat slots, and edge gaps made with the window casing. My invention avoids these problems.

U.S. Pat. No. 2,662,593

Inventor: Walker

Issued: Dec. 15, 1953

This Walker patent concerns a horizontal window blind having slats with no cord holes and no notches. The individual slats are removable for replacement or repair. The slats are held in place by a specially designed metal tension clip. The tension clip holds the slat and forms the rungs of a tilt open/tilt close ladder with the sides of the ladder made of foldable, cloth strips. The tension clips attach to the cloth strips of the ladder using sewn thread. A "free play" vertical raise open/lower close cord runs down either side of the slats and is held in place by the clips and sewn on loops. One or more vertical columns of tension clips is used across the blind width.

This Walker patent unlike my invention has the problem of excessive "stack height" in the fully tilt opened, and raised opened position. The slats are cord hole free, however, the tension clip use on concave-down, curved slats will cause too large a "stack height". "Stack height" is the height of the window blind when fully tilt opened and fully raise opened. Minimum "stack height" allows the most amount of fresh air and sunlight into a window. The Walker patent also still has Peeping Tom access through the edge gaps made with the window casing. My invention avoids these problems.

U.S. Pat. No. 2,565,840

Inventor: Clark, R. C.

Issued: Aug. 28, 1951

This Clark patent concerns a horizontal window blind having slats with no cord holes or notches. It is designed for individual slat removal and replacement. A cloth ladder is used for the tilt open/tilt close mechanism. Each cord hole free and notch free slat is simply snapped onto the rung of the cloth ladder using metal snaps. Free hanging with the blind assembly on both the right and left sides of the slats, is a special edge of slat, metal groove, slat guide used to keep sideways alignment of the slats. Each slat guide has an almost full length, vertical removal slot such that an individual slat can be unsnapped from its rung, lifted up, rotated into a vertical position, and slid out sideways out of the slat guide on one end of the window or the other end.

This Clark patent has no slat cord holes and no slat notches and so no Peeping Tom problem with the slats. The design of the cloth ladder, tilt open/tilt close mechanism with the metal snap on the rung of the ladder works for old fashioned, Venetian blind, and modern, wood blind, large and wide, slats, but, does not work for modern miniblind slats. The Clark patent has a "free hanging," solid metal, slat guide which will act as a partial "edge cover strip" which will stop some Peeping Tom edge viewing action. However, this slat guide will need some clearance with the window casing to allow for sideways sliding action, individual slat removal. This clearance will provide a Peeping Tom gap because the slat guide was not intended for stopping Peeping Tom activity.

U.S. Pat. No. 2,532,617

Inventor: Hauser et al.

Issued: December 1950

This Hauser patent covers a horizontal window blind having slats with no cord holes and no notches. The individual slats are also removable for replacement or repair. This patent uses a cloth ladder assembly for the tilt open/tilt close mechanism. The horizontal slat is first rested upon the rung of the cloth ladder. The slat is attached to the rung of the cloth ladder with a specially designed tension clip. The tension clip is shaped like two interlocking "U" shapes. One top "U" goes around the room facing edge of a slat, while one bottom "U" goes around the rung of the cloth ladder. The raise open/lower close cord goes "free play" down either side of the slats.

This Hauser patent unlike my invention has the problem of excessive light leaks in the fully lower closed and fully tilt closed operation. The slats are cord hole and notch free, however, the interlocking "U" shaped clips create areas for "light leaks" by preventing a flush tilt closure of a slat upon the upper and lower adjoining slat. The tension clip locking device can interfere with "stack height" especially with concave-down, curved slats. "Stack height" is the height of the window blind when fully tilt opened and fully raise opened. "Stack height" can greatly increase using ill-designed clips with often concave-down, curved slats. Minimum "stack height" allows the most amount of fresh air and sunlight into a window. The Hauser patent also still has Peeping Tom access through the edge gaps made with the window casing. My invention avoids these problems.

U.S. Pat. No. 2,200,349

Inventor: Walker, B.

Issued: May 14, 1940

The Walker patent was an early attempt at a cord hole free, notch free slat which could be easily removed, cleaned, and replaced if broken. A cloth ladder is used for the tilt open and tilt close action with the slat resting freely on top of the ladder's rung. A "free play" cord going down opposite sides of the cloth ladder provides raise open and lower close action. The alternative embodiment has no slat cord holes, but, has two opposing side, notched slats. The notches act as guides for the "free play" raise open/lower close cord The Walker patent in its preferred embodiment has no slat cord holes for Peeping Tom action and no notches for light leaks. The alternative embodiment has no slat cord holes, but, has two opposing side, notched slats to act as guides for the "free play" raise open/lower close cord. The notched slats will allow light leaks. In all uses of the Walker patent, the edge gaps will have a Peeping Tom problem in certain "inside the window casing" blind mounts. In this type of blind mounting, the blind is attached hanging entirely inside off the window casing by attachment on the window casing top edge.

U.S. Pat. No. 2,037,393

Inventor: Roberts, L. R.

Issued: Apr. 14, 1936

The Roberts patent uses cord hold free slats which are held in place by a "C-shaped" clip which has the open part of the "C-shape" pointing towards the ceiling. The slat is passed through the open part of the clip. The room facing or "bottom of C-shape" clip edge has a metal pivoting attachment to a cloth ladder assembly with the clip forming the rung of the ladder when viewed from the edge of the blind. The street facing or "top of C-shape" clip edge also has a metal pivoting attachment to the cloth ladder assembly. The ladder assembly provides the tilt open/tilt close operation. The raise open and lower close actions are done by vertical cords which are strung "free play" down either side of the cloth ladder.

The Roberts patent has no slat cord holes in the slats. The pivoting, "C-shaped" clip will produce light leaks in a fully tilt closed and lowered close blind by interfering with the flush closure of the slat edge with adjoining slats. Also the "C-shaped" clip will produce too large a minimum "stack height" in a fully tilt open and raise opened blind. "Stack height" can greatly increase using ill-designed clips with often concave-down, curved slats. There is also no edge gap protection against Peeping Toms.

U.S. Pat. No. 1,327,363

Inventor: Wilson, P. H. & Sapper, C. H.

Issued: Jan. 6, 1920

The Wilson patent is very similar to the Roberts patent in using a "C-shaped" clip to hold a slat with no cord holes or notches. However, its objective is for weather proof, exterior storm windows using solid metal slats. Burglars can use bolt cutters and crow bars to remove the metal slats, so, high security use is not intended. The open side of the "C-shape" faces the ceiling. The edges of the "C-shaped" clip are pivot attached to a vertical, center of slat, metal spacer, sideways folding, "zigzag" mechanism. The entire assembly forms a metal ladder mechanism when viewed from the edges of the blind. The metal ladder mechanism does the tilt open/tilt close operation. A metal chain link extends down the two outer edges of the blind to do the raise open/lower close operation.

The Wilson patent has no edge gap protection for Peeping Toms. It is of all solid, metal construction and intended for exterior, storm windows.

Dansk Patent Number 104,703

Inventor: Koch, Firmaet Juliet

Issued: September 1966

The Koch patent uses a wide band, "C-shaped" clip to hold a slat with no cord holes or notches. The open side of the "C-shape" faces the floor. The bottom of "C-shape" is wide enough to hold a pivot bar. The top of "C-shape" is wide enough to hold a pivot bar. Four vertical cords are attached to the ends of each pivot bar with two vertical cords on the room facing side of the clip and also two vertical cords on the street facing side of the clip. The towards the room, slat edge, pivot bars form the rungs of a towards the room facing, ladder. The towards the street, slat edge, pivot bars form the rungs of a towards the street facing, second ladder. These ladders should not be confused with a single, prior art cloth or cord tilt open/tilt close ladder. The Koch patent's tilt open/tilt close operation is performed by raising one ladder while lowering the opposing end's ladder. The raise open/lower close operation is performed by some untranslatable mechanism.

The koch patent has no edge gap protection for Peeping Toms.

While these devices may be suitable for the purposes for which they were designed, they would not be suitable for the purposes of the present invention, as hereinafter described.

Therefore, it is believed that a need exists for a high privacy horizontal window blind design, which is economical to buy and manufacture, comes only in newly factory built window blinds, does not impede blind operation in any way, and allows full tilt closing in both directions.

SUMMARY OF THE PRESENT INVENTION

This invention provides a means for horizontal window blinds to use cord hole free, horizontal slats and also an edge blocking device with means for preventing Peeping Toms (916) from viewing into high privacy areas.

OBJECTS AND ADVANTAGES VS. PRIOR ART

A). An object and advantage of the present invention is to be a design in approach to high privacy horizontal window blinds which does not compromise in any way the operation of the device.

Current high privacy built-in designs compromise horizontal window blind operation in some way or form. The Levolor (R) After Dark (R) model mentioned in the Prior Art is high privacy only in some installations with narrow windows which allow placement of dedicated and separated raise open/lower close cords very near the window casing edge, thus using the narrow window frame to block Peeping Toms (916) viewing through the "free play", vertical, slat control cord holes. The dedicated and separated tilt close/tilt open control cords are placed in the middle of the blind, since, they do not require slat cord holes. A very wide blind needs more than two dedicated and separated raise open and lower shut cords near the middle of the blind which re-introduces a Peeping Tom (916) problem through the vertical, slat control cord holes.

Hunter-Douglas (R) high privacy designs mentioned in the prior art which seem to be preceded by the Chen patent, U.S. Pat. No. 5,386,867 (see BACKGROUND—Relevant Prior Art Patent Summary), allow full tilt closure only in the street edge down position. Tilt closure in the street edge up position only occurs partially.

The Tuzmen Patents introduce huge increases in "light leaks" for a fully tilt closed and lowered closed blind. The "minimum stack height" or the height of the piled up slats of a fully tilt open and raised open horizontal window blind is also greatly increased. "Stack height" can greatly increase using ill-designed clips with often concave-down, curved slats.

Other U.S. patents have major problems with introducing "light leaks" in fully tilt closed and lowered closed blinds. Also the minimum stack height becomes too great.

My U.S. patent application Ser. No. 09,648,602 filed on Aug. 26, 2000 (see BACKGROUND—Cross Reference to My Related Inventions), covers an add-on device to stop the Peeping Tom (916) problem.

B). An object and advantage of the present invention is to provide a device that prevents Peeping Toms (916) from gazing through the control cord holes in the slats of typical window blinds.

Peeping Toms (916) can currently peer or else video tape with telephoto lenses through the cord holes and through the edge gaps of fully closed miniblinds. For profit World Wide Web sites have been set up showing pictures of partially undressed and fully undressed unsuspecting females who have been candidly and without expressed consent been videotaped by such Peeping Toms (916). The full video identities of these women who are people's wives, mother's and daughters are shown to a worldwide audience. Many of these sites are out of US jurisdiction, so, there is no way to legally stop this activity. The best option is to stop the activity at its source.

The Levolor (R) After Dark (R) model only fixes this problem in some blind installations as mentioned in A). This design still has edge gap Peeping Tom (916) problems when the blind is installed inside of a window casing.

The Hunter Douglas design (apparently preceded by the Chen patent, U.S. Pat. No. 5,386,867) only fixes this problem in some blind installations as mentioned in A). This design still has edge gap Peeping Tom (916) problems when the blind is installed inside of a window casing.

C). An object and advantage of the present invention is to provide such a device which comes on newly factory built horizontal window blinds, which can be installed at the dwelling without the use of special tools or expertise.

As opposed to the design of this patent which provides a design in or manufacturer's solution to the Peeping Tom (916) problem, my U.S. patent application Ser. No. 09,648,602 filed on Aug. 26, 2000 (see BACKGROUND—Cross Reference to My Related Inventions), covers an add-on device to stop the Peeping Tom (916) problem.

D). An object and advantage of the present invention is to provide such a device that is inexpensive to buy and inexpensive to manufacture.

Many previous designs such as the Tuzmen US patents (U.S. Pat. No. 's 5,918,657 and 5,769,140), require expensive use of metal parts instead of possible material, concave-down, shape conforming, cheap plastic clips as in my invention.

E). An object and advantage of the present invention is to provide such a device in the form of a clip and also an edge cover strip which can be of whatever color or pattern is necessary to properly blend with the existing window blinds and the room interior.

The Schaller patent (U.S. Pat. No. 4,341,254) (assigned to Levolor) provides a decorative solid, aluminum frame with edge cover protection. The accent frame can be chosen to match the interior of a room or contrast with the slat color. The various embodiments of mechanisms for attaching the frame is mechanically cumbersome and inefficient. The frame is fairly permanent.

F). An object and advantage of the present invention is to allow the clip to be of different colors to match the window blind color.

Most clip based prior art inventions used metal clips which were of limited color choices.

G). An object and advantage of the present invention is to provide a decorator item where the clip and edge cover strips can serve to accent the solid blind color, the clip and edge cover strips can have cartoon characters to decorate children's bedrooms, the clip and edge cover strips can have a person's name or family crest, and other decorative or accent uses.

The Schaller patent (U.S. Pat. No. 4,341,254) (assigned to Levolor) provides a decorative solid, aluminum frame with edge cover protection. The accent frame can be chosen to match the interior of a room or contrast with the slat color. The various embodiments of mechanisms for attaching the frame is mechanically cumbersome and inefficient. The frame is fairly permanent.

H). An object and advantage of the present invention is to provide such a device that allows the edge cover strip to be easily removed for cleaning or altering colors of the edge cover strip.

The Schaller patent (U.S. Pat. No. 4,341,254) (assigned to Levolor) provides a decorative solid, aluminum frame with edge cover protection. The accent frame can be chosen to match the interior of a room or contrast with the slat color. The various embodiments of mechanisms for attaching the frame is mechanically cumbersome and inefficient. The frame is fairly permanent.

I). An object and advantage of the present invention is to provide such a device that is easily removable in its entirety for cleaning or dusting of the window frame or the blind.

Older prior art horizontal, Venetian blinds required unscrewing of the headrail for removal, washing with light soap, spraying, and sun drying.

Newer prior art horizontal, miniblinds using screw-in, snap open/snap close, aluminum headrail holders, allowed tool-less blind removal from the headrail, washing with light soap, spraying, and sun drying.

J). An object and advantage of the present invention is to provide such a device that does not interfere in any way with the tilt closing (minimal "light leaks"), tilt opening and raising open the fully tilt open blinds (minimal "stack height"), or lowering close the fully tilt open blind.

Especially important is full tilt opening and tilt closing in both directions of front slat edge up and down when viewing the blind from inside of a room. This object has not been met by prior art high privacy blind designs such as the Hunter Douglas (R) design or the Chen patent (U.S. Pat. No. 5,386,867). Also relevant in this regard is the amount of "light leaks" in a fully lowered shut and tilt close operation. Many prior art high privacy designs introduce too many "light leaks", thus, making them impractical and not commercially viable. The objective of low "light leaks" is obvious for the benefit of sleeping persons and people wishing high privacy in bedrooms and bathrooms.

Especially important is full raise open/lower close operation. The object is to minimize "stack height" or the vertical height of the stacked slats after a full tilt open and raise open operation. This objective has not been met by many prior art high privacy blind designs. The objective of minimized "stack height" is obvious for allowing maximum air flow, maximized unobstructed outside or street view, and light entry when the user wishes such conditions such as on the first warm day of spring after a long, dark, and cold winter.

Especially important is no or very little increase in the reaction time and effort for raise open/lower close operation and tilt open/tilt close operation in either tilt direction. Mechanically efficient mechanisms with little waste of energy due to excessive friction and cord tangling or misdirection is important. Many prior art high privacy designs have caused a large increase in reaction time and human effort from frictional waste, cord tangling and misdirection leading to commercial infeasibility due to inconvenience.

K). An object and advantage of the present invention is to provide an edge device that prevents Peeping Toms (916) from gazing through the gaps created at the ends of the window blinds in those installations where the window blinds are recessed within a window casing.

The Schaller patent (U.S. Pat. No. 4,341,254) covers the edge gap with a stiff, aluminum slotted guide for the blind. There is no stated intention to block out Peeping Toms (916) in the patent, but, this effect occurs. The Schaller "edge blocking members" are not removable. However, the Schaller patent does not stop Peeping Toms (916) from peering through the slat cord holes.

L). An object and advantage of the present invention is to provide such a clip device that detachably fastens about the cord hole free, window blind slats in such a manner that a bent or damaged cord hole free window blind slat can be removed or replaced.

Children and dogs often bend blind slats resulting in poor operation and an ugly crumpled slat appearance. Replacement of individual slats is a desirable feature.

M). An object and advantage of the present invention is to provide a plurality of such clip devices which are detachably fastened to a corresponding plurality of cord hole free, window blind slats, such clip devices being vertically aligned to receive one pair of raise open/lower close, "free play" control cords, and one pair of attached tilt open/tilt close control cords.

N). An object and advantage of this invention is to have no necessity for tilt open/tilt close control cord rope ladder rungs which look like the steps upon a rope ladder of prior art horizontal window blinds. The slats rest upon the horizontal steps in prior art blinds.

O). An object and advantage of the present invention is to provide duplicated sets of such clip devices which can be used with similar operation for each of the multiple vertical control cord columns across a blind.

A small blind will have at least two sets of vertical control cord columns and a wide blind will have up to five sets of vertical control cord columns.

P). An object and advantage of the present invention is to provide such clip devices with loops that are shaped to receive two pairs of control cords, the tilt open/tilt close control cord pair and the raise open/lower close control cord pair.

Such control cords must be retained in an untwisted and untangled position throughout the operations of tilt open, tilt close, full and partial raising open and lowering close.

Q). An object and advantage of the present invention is to provide a device which can be sold at the retail or discount store in components with slats of different lengths custom cut and sold separately from the frame integrated with control cord mechanisms.

This components approach will allow at the store custom slat length cutting of the slats for retrofit upon an adjustable length frame. The object is to avoid the current need for a two week turn-around time on factory ordered, custom manufactured horizontal window blinds.

Additional objects of the present invention will appear as the description proceeds.

BRIEF DESCRIPTION OF THE DRAWING

FIGURES

Various other objects, features and attendant advantages of the present invention will become more fully appreciated as the same becomes better understood when considered in conjunction with the accompanying drawings, in which like reference numbers designate the same or similar parts throughout the several views.

Figure 1:
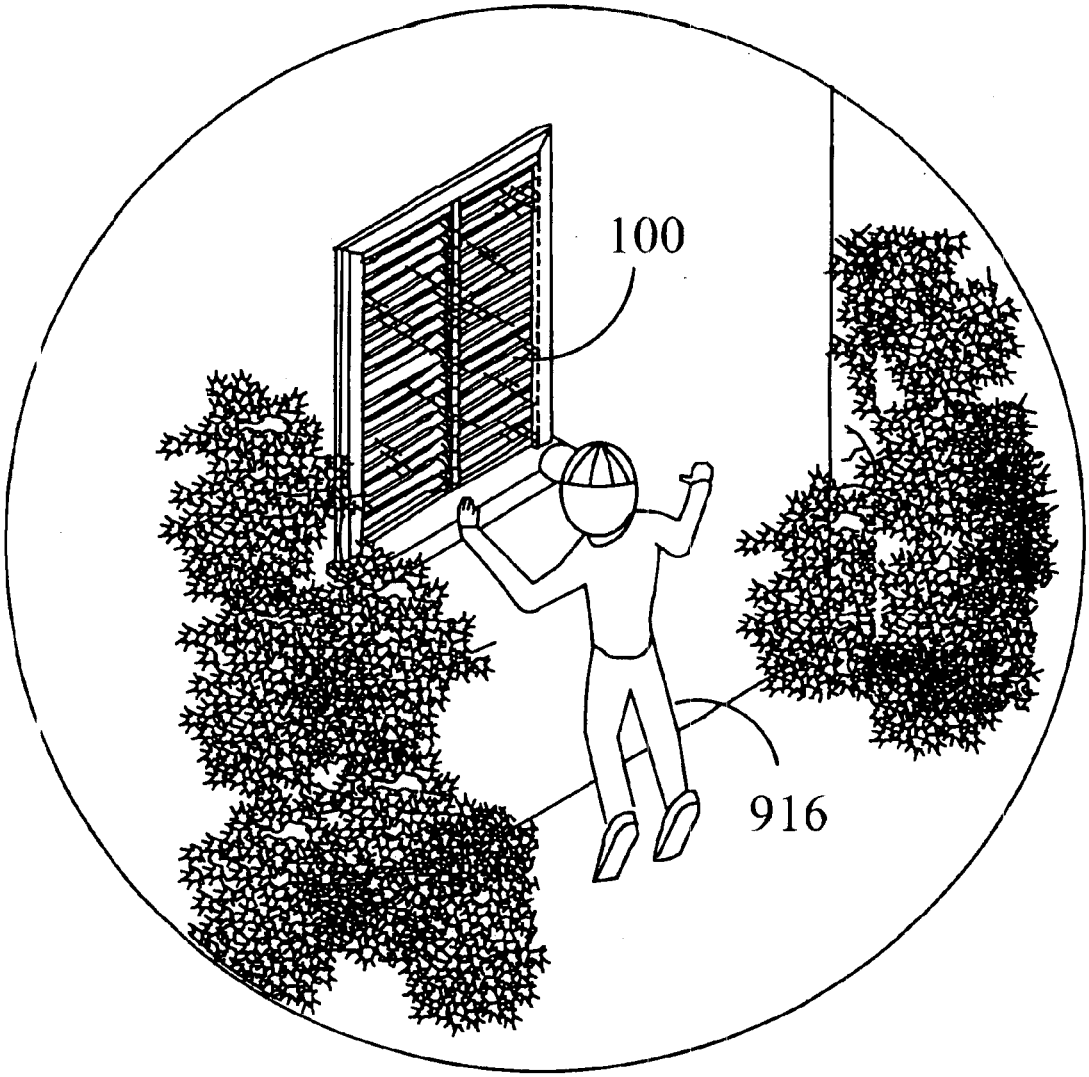

FIG. 1 is a representation of the Peeping Tom (916) problem. The Peeping Tom (916) is shown trying to peep through the control cord holes of prior art horizontal window blinds even while the blind is fully tilt closed and lowered close. Failing this, he will try to peep through the Window Casing Right Side (900) or Window Casing Left Side (904).

Figure 2:
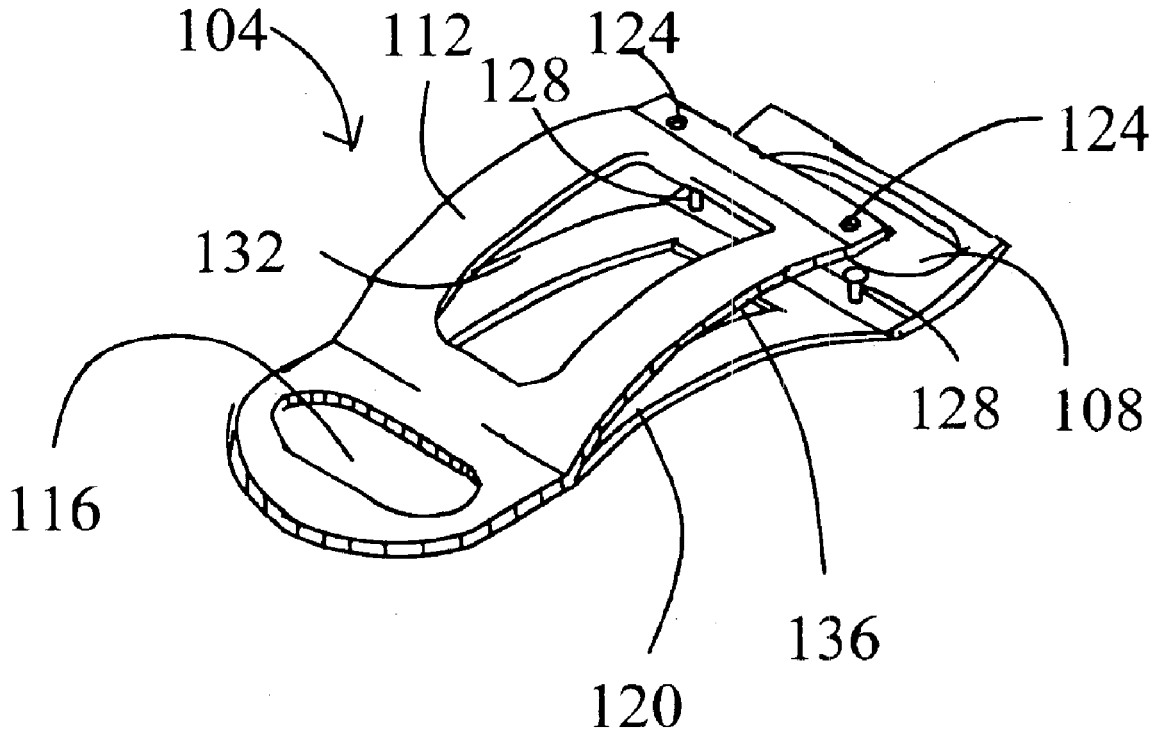

FIG. 2 is a perspective view of the Clip (104) in detail.

Figure 3:
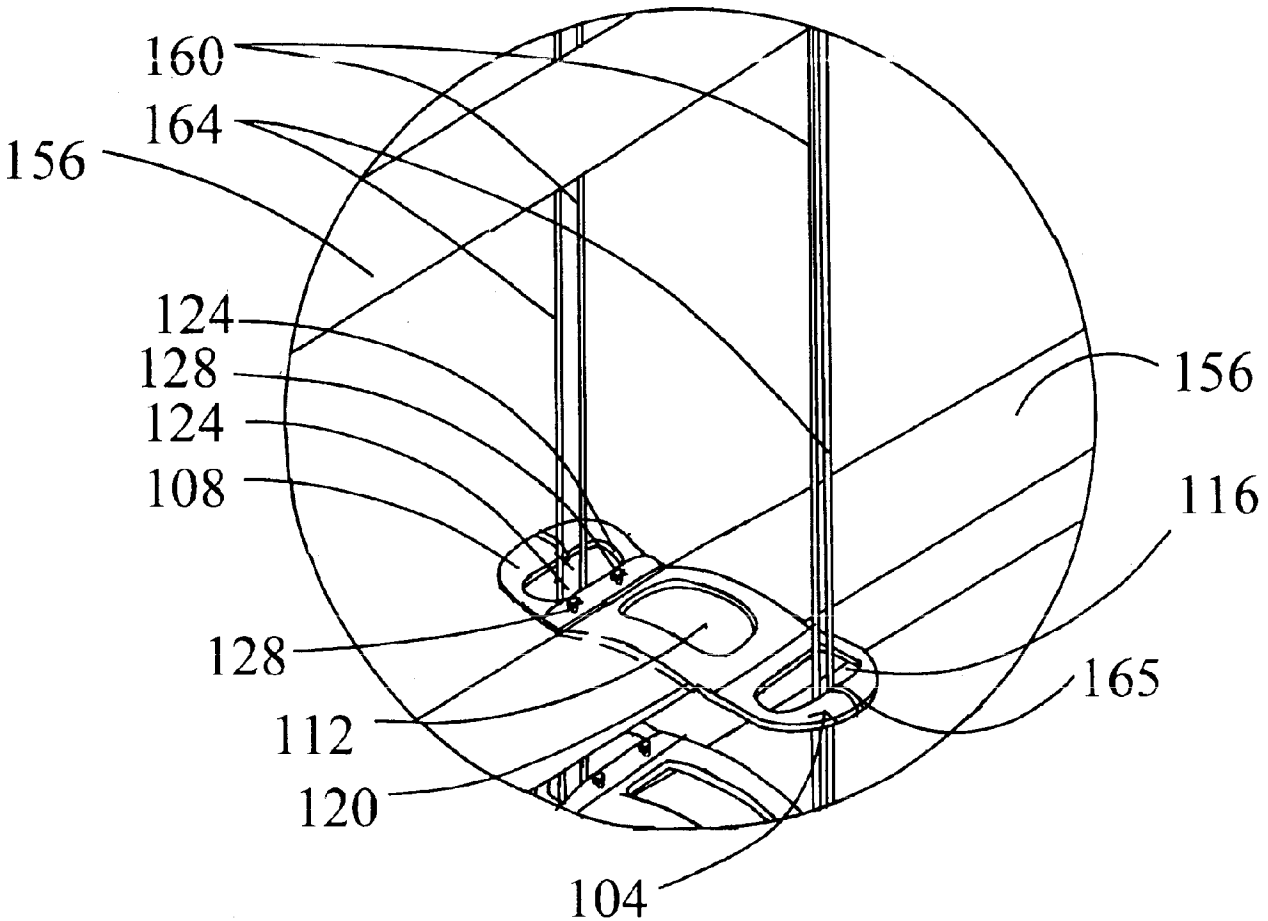

FIG. 3 is a perspective view of the Clip (104) attached to a Control Cord Hole Free Window Blind Slat (156). The Window Blind Raising Open and Lowering Close Control Cord Pair (160) and their "free play" attachment to the Clip (104) is shown. The Window Blind Tilt Control Cord Pair (164) are shown with the Tilt Control Cord Pair Knot (165) used to tie it to the Clip (104).

Figure 4:
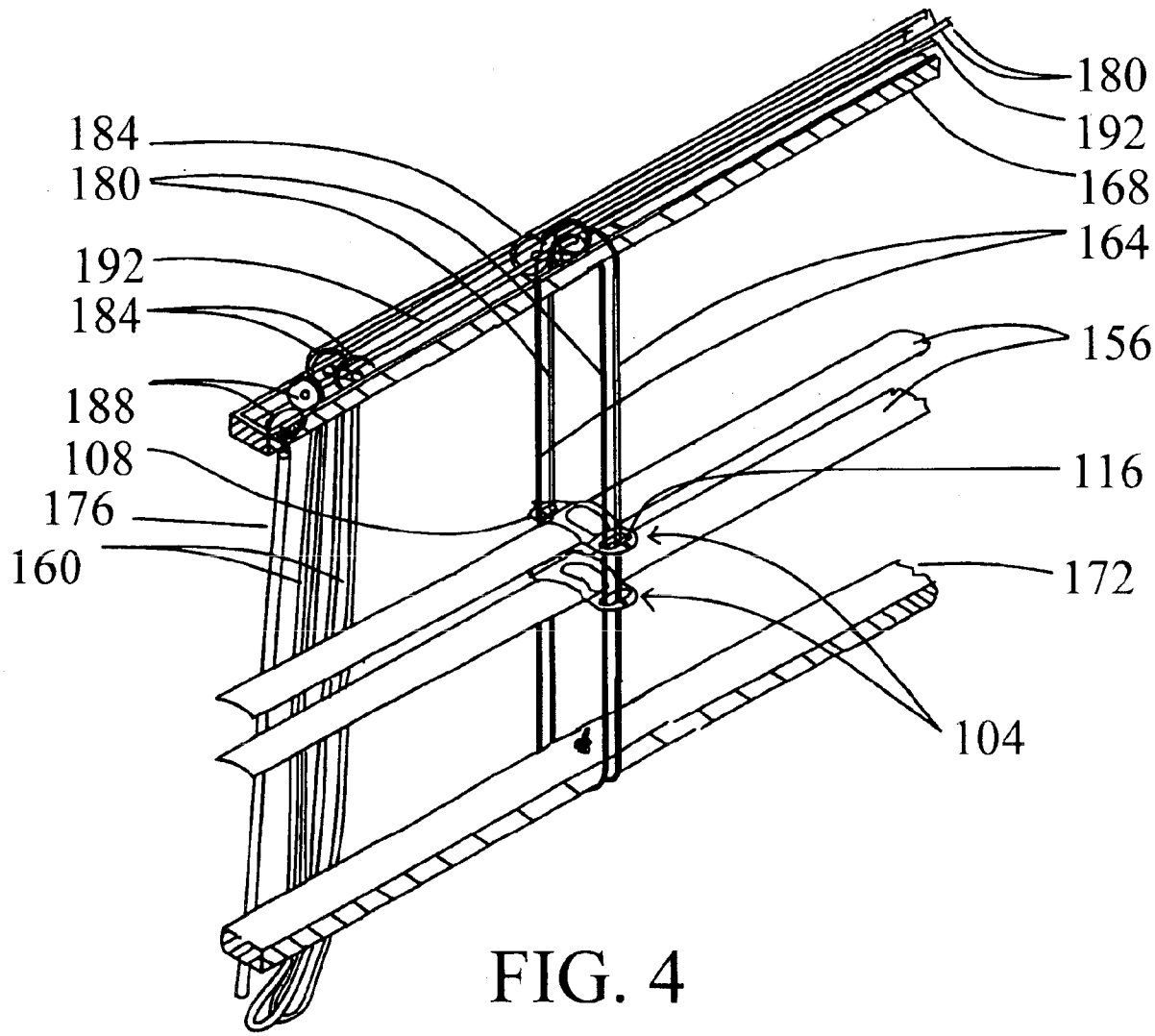

FIG. 4 is a perspective view of the operation of the Window Blind Raising Open and Lowering Close Control Cord Pair (160) used to raise and lower the blind and the Window Blind Tilt Control Cord Pair (164) used to tilt open and tilt close the blind. The operation of the Double Pulleys for Raise and Lower Control Cords (184) are shown. The operation of the Tilt Rod with Cord Winches (192) is shown. The operation of the Tilt Open and Tilt Close Wand (176) is shown.

Figure 5:
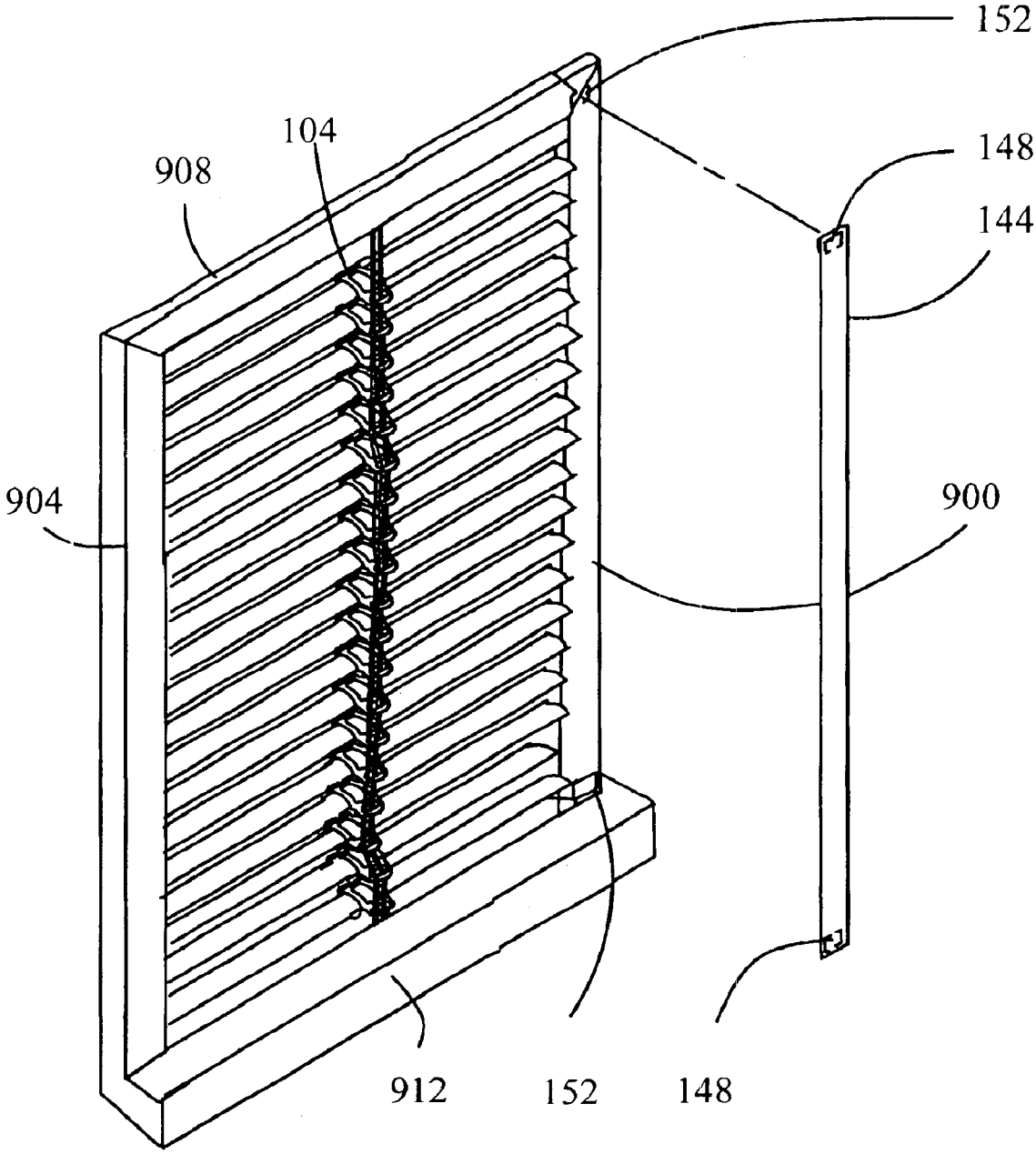

FIG. 5 is a perspective view of an installation of the complementary Left Edge Cover Strip (140) along the Window Casing Left Side (904) and Right Edge Cover Strip (144) along the Window Casing Right Side (900).

DESCRIPTION OF THE REFERENCED NUMERALS

Turning now descriptively to the drawings, in which similar reference characters denote similar elements throughout the several views, the FIGURES illustrate the Peeping Tom deterrent device (100) for horizontal window blinds of the present invention. With regard to the reference numerals used, the following numbering is used throughout the various drawing figures.

Elements in all Embodiments:

100 Peeping Tom Deterrent Design for Horizontal Window Blinds of the Present Invention
104 Clip
108 Front Loop (room facing)
112 Device First Portion (top)
116 Rear Loop (street facing)
120 Device Second Portion (bottom)
124 Snap Tab Holes
128 Snap Tab Protrusions
132 Device First Portion Center Hole
136 Device Second Portion Center Hole
140 Left Edge Cover Strip
144 Right Edge Cover Strip
148 Positive Hook and Loop Fastener Pad
152 Negative Hook and Loop Fastener Pad
156 Control Cord Hole Free Window Blind Slat
160 Window Blind Raising Open and Lowering Close Control Cord Pair
164 Window Blind Tilt Control Cord Pair
165 Window Blind Tilt Control Cord Pair Knot
168 Window Blind Head Rail
172 Window Blind Bottom Board
176 Tilt Open and Tilt Close Wand
180 Raise Open and Lower Close Control Cord Pair User Cord Loops
184 Double Pulleys for Raise and Lower Control Cords
188 Tilt Rod Differential Gear with Tilt Wand Attachment
192 Tilt Rod with Cord Winches
200 Valence (used only in certain outside the window casing blind mountings to hold and cover the Head Rail)

Elements in Alternative Embodiments Only:

800.

Elements not Part of Invention:

900 Window Casing Right Side
904 Window Casing Left Side
908 Window Casing Top
912 Window Casing Bottom
916 Peeping Tom

DETAILED DESCRIPTION OF THE PREFERRED EMBODIMENT

Turning now descriptively to the drawings, in which similar reference characters denote similar elements throughout the several view, FIGS. 1 through 4 illustrate the Peeping Tom deterrent device (100) for horizontal window blinds of the present invention, indicated generally by the numeral (98).

FIG. 1 is a representation of the Peeping Tom problem.

The Peeping Tom Deterrent Design for Horizontal Window Blinds of the Present Invention (100) is installed, and when the Control Cord Hole Free Window Blind Slats (156) are tilt closed and lowered close, will prevent the Peeping Tom (916) from gazing through the Control Cord Hole Free Window Blind Slats (156), furthermore, the Left Edge Cover Strip (140), and the Right Edge Cover Strip (144) prevent the Peeping Tom (916) from gazing around the Window Casing Right Side (900) and Window Casing Left Side (904) which are shown in relation to the Window Casing Top (908) and the Window Casing Bottom (912), furthermore, the Clip (104) with a Front Loop (108) and a Rear Loop (116) and a Window Blind Tilt Control Cord Pair Knot (196), plus Snap Tap Holes (106) are shown on the Clip (104), furthermore, the Window Blind Raising Open and Lowering Close Control Cord Pair (160) and the Window Blind Tilt Control Cord Pair (164) are shown threaded through and attached to the clip loops (108, 116) in relation to the Window Blind Head Rail (168) and the Window Blind Bottom Board (172) and the Raise Open and Lower Close Control Cord Pair User Cord Loops (180).

FIG. 2 is a perspective view of the Clip (104) in detail.

It shows the Front Loop (108), Device First Portion (top) (112), Rear Loop (116), Device Second Portion (bottom) (120), Device First Portion Center Hole (132) for reduced material use, Second Portion Center Hole (136) for reduced material use, Control Cord Hole Free Window Blind Slat (156), Snap Tap Holes (106), Snap Tab Protrusions (128), Window Blind Raising Open and Lowering Close Control Cord Pair (160), Window Blind Tilt Control Cord Pair (164), Window Blind Tilt Control Cord Pair Knot (196).

In one minor alternative to the preferred embodiment, the Device First Portion (top) (112), and Device Second Portion (bottom) (120), have a conforming concave shape to match the "C-shape", open-edge of "C-shape" facing towards the floor, concave shape of an aluminum, mini-blind slat. The slats of wood horizontal blinds are not concave in shape, but, perfectly flat. This feature is meant to minimize "stack height" which is the minimum height of a fully tilt opened and raised open blind. Excessive "stack height" is a major failing in most prior art, cordhole free, horizontal window blind designs.

In one minor alternative to the preferred embodiment, the Control Cord Hole Free Window Blind Slat (156) having no notches needs some attachment guide for the Clip (104). A clip placement marking is factory painted on the Slat (156). In this embodiment, the use of friction alone between a possible, concave, mini-blind Slat (156) or a straight, wood blind Slat (156) and the possible plastic material clip (104) will hold the Slat (156) in place during all normal operations. This is unlike many prior art Control Cord Hole Free Window Blind Slat designs with no notches in which the Slat (156) is "loose" often slipping out of vertical alignment during normal blind operations.

In this embodiment the Clip (104) is made of plastic, although other types of materials, such as various woods and metals, can also be used, in accordance with the present invention, and as determined by the intended end use for the overall device, as will occur to those of skill in the art upon review of the present disclosure.

The device is particularly suited for mini-blinds with aluminum window blind slats, although other types of blinds, such as Venetian blinds and wood blinds, can also be used, in accordance with the present invention, and as determined by the intended end use for the overall device, as will occur to those of skill in the art upon review of the present disclosure.

FIG. 3 is a perspective view of the Clip (104) attached to a Control Cord Hole Free Window Blind Slat (156). The Window Blind Raising Open and Lowering Close Control Cord Pair (160) and their "free play" attachment to the Clip (104) is shown. The Window Blind Tilt Control Cord Pair (164) are shown with the Tilt Control Cord Pair Knot (165) used to tie it to the Clip (104).

In detail it shows that full raise open/lower close operation can occur with the use of the Control Cord Hole Free Window Blind Slat (156). In detail it also shows that full tilt open/tilt close in either tilt direction operation can occur with the use of the Control Cord Hole Free Window Blind Slat (156).

FIG. 4 is a perspective view of the operation of the Window Blind Raising Open and Lowering Close Control Cord Pair (160) used to raise and lower the blind and the Window Blind Tilt Control Cord Pair (164) used to tilt open and tilt close the blind. The operation of the Double Pulleys for Raise and Lower Control Cords (184) are shown. The operation of the Tilt Rod with Cord Winches (192) is shown. The operation of the Tilt Open and Tilt Close Wand (176) is shown.

In detail it shows the Window Blind Head Rail (168), Window Blind Bottom Board (172), Tilt Open and Tilt Close Wand (176), Raise Open and Lower Close Control Cord Pair User Cord Loops (180), Double Pulleys for Raise Open and Lower Close Control Cords (184), Tilt Rod Differential Gear with Tilt Wand Attachment (188) Tilt Rod with Cord Winches (192), and Window Blind Tilt Control Cord Pair Knot (196).

FIG. 5 is a perspective view of an installation of the complementary Left Edge Cover Strip (140) along the Window Casing Left Side (904) and Right Edge Cover Strip (144) along the Window Casing Right Side (900).

The use of Positive Hook and Loop Fastener Pads (148) and Negative Hook and Loop Fastener Pads (152) is shown. The Window Casing Left Side (904), Window Casing Right Side (900), and the Window Casing Bottom (912) are shown.

DETAILED DESCRIPTION OF THE OPERATION OF THE PREFERRED EMBODIMENT

Turning now descriptively to the drawings, in which similar reference characters denote similar elements throughout the several view, FIGS. 1 through 4 illustrate the Peeping Tom Deterrent Device for Horizontal Window Blinds of the Present Invention (100).

FIG. 1 is a representation of the Peeping Tom (916) problem.

The Peeping Tom Deterrent Design for Horizontal Window Blinds of the Present Invention (100) is installed, and when the Control Cord Hole Free Window Blind Slats (156) are tilt closed and lowered close, will prevent the Peeping Tom (916) from gazing through the Control Cord Hole Free Window Blind Slats (156), furthermore, the Left Edge Cover Strip (140), and the Right Edge Cover Strip (144) prevent the Peeping Tom (916) from gazing around the Window Casing Right Side (900) and Window Casing Left Side (904) which are shown in relation to the Window Casing Top (908) and the Window Casing Bottom (912), furthermore, the Clip (104) with a Front Loop (108) and a Rear Loop (116) and a Window Blind Tilt Control Cord Pair Knot (196), plus Snap Tap Holes (106) are shown on the Clip (104), furthermore, the Window Blind Raising Open and Lowering Close Control Cord Pair (160) and the Window Blind Tilt Control Cord Pair (164) are shown threaded through and attached to the clip loops (108, 116) in relation to the Window Blind Head Rail (168) and the Window Blind Bottom Board (172) and the Raise Open and Lower Close Control Cord Pair User Cord Loops (180).

The Peeping Tom (916) is deterred when the Control Cord Hole Free Window Blind Slats (156) are tilt closed and lowered close, which prevents the Peeping Tom (916) from gazing through the Control Cord Hole Free Window Blind Slats (156), furthermore, the Left Edge Cover Strip (140), and the Right Edge Cover Strip (144) prevent the Peeping Tom (916) from gazing around the Window Casing Right Side (900) and Window Casing Left Side (904).

FIG. 2 is a perspective view of the Clip (104) in detail.

It shows the Front Loop (108), Device First Portion (top) (112), Rear Loop (116), Device Second Portion (bottom) (120), Device First Portion Center Hole (132), Second Portion Center Hole (136), Control Cord Hole Free Window Blind Slat (156), Snap Tap Holes (106), Snap Tab Protrusions (128), Window Blind Raising Open and Lowering Close Control Cord Pair (160), Window Blind Tilt Control Cord Pair (164), Window Blind Tilt Control Cord Pair Knot (196).

In this embodiment the Control Cord Hole Free Window Blind Slat (156) has a slight top and bottom notch for attachment of the Clip (104) in order to keep flush slat (140) edges between the slat (140) depicted and the top and bottom slat (140) when tilt closed up or down. This feature prevents light leaks through spacings introduced by the Clip (104).

The attachment of the Clip (104) to the Control Cord Hole Free Window Blind Slat (156) is detailed. When attached, the Device First Portion (top) (112) and Device Second Portion (bottom) (120) can be positioned to closely receive the Control Cord Hole Free Window Blind Slat (156) which prevents transverse slippage. During Clip (104) insertion around the Control Cord Hole Free Window Blind Slat (156), the Window Blind Raising Open and Lowering Close Control Cord Pair (160) and the Window Blind Tilt Control Cord Pair (164) have not yet been factory installed. Once the Control Cord Hole Free Window Blind Slat (156) has been positioned within the Device First Portion (top) (112) and the Device Second Portion (bottom) (105), the two portions can be snapped together. This snapping is done by squeezing the two Snap Tab Protrusions (128) on the Device Second Portion (bottom) (120) into the two corresponding Snap Tab Holes (124) on the Device First Portion (top) (112). This joinder fastens the Clip (104) about the Control Cord Hole Free Window Blind Slat (156) until the owner chooses to replace a broken or bent slat by pulling the Snap Tab Protrusions (128) out of the Snap Tab Holes (124).

The Window Blind Raising Open and Lowering Close Control Cord Pair (160) and the Window Blind Tilt Control Cord Pair (164) are factory installed in the next step shown in FIG. 3.

FIG. 3 is a perspective view of the operation of the Window Blind Raising Open and Lowering Close Control Cord Pair (160) used to raise and lower the blind and the Window Blind Tilt Control Cord Pair (164) used to tilt open and tilt close the blind.

In detail it shows the Window Blind Head Rail (168), Window Blind Bottom Board (172), Tilt Open and Tilt Close Wand (176), Raise Open and Lower Close Control Cord Pair User Cord Loops (180), Double Pulleys for Raise Open and Lower Close Control Cords (184), Tilt Rod Differential Gear with Tilt Wand Attachment (188), Tilt Rod with Cord Winches (192), and Window Blind Tilt Control Cord Pair Knot (196).

The installation of the Window Blind Raising Open and Lowering Close Control Cord Pair (160) and the Window Blind Tilt Control Cord Pair (164) follows the FIG. 2 installation of the Clips (104) along a vertical column for every slat. The installation of the Window Blind Raising Open and Lowering Close Control Cord Pair (160) through the Window Blind Head Rail (168) follows. These cords are passed through the Double Pulleys for Raise Open and Lower Close Control Cords (184) inside of the Window Blind Head Rail (168). These cords come out as the Raise Open and Lower Close Control Cord Pair User Cord Loops (180).

The installation of the Window Blind Tilt Control Cord Pair (164) through the Window Blind Head Rail (168) follows. These cords are looped around the Tilt Rod with Cord Winches (192), which in turn are rotated by the Tilt Rod Differential Gear with Tilt Wand Attachment (188) all inside of the Window Blind Head Rail (168). The Tilt Rod Differential Gear with Tilt Wand Attachment (188) is user operated by the user using the Tilt Open and Tilt Close Wand (176).

The Window Blind Raising Open and Lowering Close Control Cord Pair (160) and Window Blind Tilt Control Cord Pair (164) for additional vertical columns of attached Clips (104), can be installed in a similar manner. These cords for multiple vertical columns of attached Clips (104) are passed through the same Double Pulleys for Raising Open and Lowering Close Control Cords (184) all inside of the Window Blind Head Rail (168).

The attachment of cords to a vertical column of the Control Cord Hole Free Window Blind Slats (156) comes last. The Front Loop (108) is sized to receive a "free play" Window Blind Raising Open and Lowering Close Control Cord Pair (160) single cord. The Front Loop (108) is sized to also receive a Window Blind Tilt Control Cord Pair Knot (196) used to attach only one Window Blind Tilt Control Cord Pair (164) single cord per front side. These two cords are attached to all Clips (104) in a vertical column, then looped around and tied to the Window Blind Bottom Board (172) and then brought back up the other side in a similar manner. The Rear Loop (116) is sized to receive a "free play" Window Blind Raising Open and Lowering Close Control Cord Pair (160) single cord. The Rear Loop (116) is sized to also receive a "knot tied" Window Blind Raising Open and Lowering Close Control Cord Pair (144) single cord.

The Tilt Open and Tilt Close Wand (176) is used to tilt open and tilt close the Control Cord Hole Free Window Blind Slats (156).

The Raise Open and Lower Close Control Cord Pair User Cord Loops (180) are used to raise and lower the Control Cord Hole Free Window Blind Slats (156).

FIG. 4 is a perspective view of an installation of the complementary Left Edge Cover Strip (140) along the Window Casing Left Side (904) and Right Edge Cover Strip (144) along the Window Casing Right Side (900).

The use of Positive Hook and Loop Fastener Pads (148) and Negative Hook and Loop Fastener Pads (152) is shown. The Window Casing Left Side (904), Window Casing Right Side (900), and the Window Casing Bottom (912) are shown.

In some window blind installations as in FIG. 4, the Control Cord Hole Free Window Blind Slat (156) is recessed within a Window Casing Bottom (912), Window Casing Left Side (904), Window Casing Right Side (900), and a Window Casing Top (908). This is in alternative to other installations where the Control Cord Hole Free Window Blind Slat (156) extends beyond the Window Casing Left Side (904) and the Window Casing Right Side (900). With recessed installations, two possible views exist between the gap created between the end of the Control Cord Free Window Blind Slat (156) and the Window Casing Left Side (904) and secondly, the gap created between the end of the Control Cord Free Windows Blind Slat (140) and the Window Casing Right Side (900). Complimentary edge vision block members, such as Left Edge Cover Strips (140) and Right Edge Cover Strips (144) are provided which have sufficient width to block this view. Typical Positive Hook and Loop Fastener Pads (148) and Negative Hook and Loop Fastener Pads (152) are provided to attach the Left Edge Cover Strips (140) and the Right Edge Cover Strips (144) to the Window Casing left Side (904) and Window Casing Right Side (900). This attachment should properly position the Left Edge Cover Strip (140) and Right Edge Cover Strip (144) such that the two edge gap views are blocked and the normal operation of raising and lowering blinds is not impeded and the normal operation of tilt opening and tilt closing blinds is not impeded. This position will typically involve the Left Edge Cover Strip (140) extending, part, beyond the inside edge of the Window Casing Left Side (904), and Right Edge Cover Strip (144) extending, in part, beyond the inside edge of the Window Casing Right side (900).

ADVANTAGES OF THE PREFERRED EMBODIMENT

A). An advantage of the present invention is to be a design in approach to high privacy horizontal window blinds which does not compromise in any way the operation of the device.

B). An advantage of the present invention is to provide a device that prevents Peeping Toms (916) from gazing through the control cord holes in the slats of typical window blinds.

This is accomplished through the use of the Control Cord Hole Free Window Blind Slats (156) and the Left Edge Cover Strip (140) and the Right Edge Cover Strip (144).

C). An advantage of the present invention is to provide such a device which comes on newly factory built, horizontal, window blinds, which can be installed at the dwelling without the use of special tools or expertise.

This comes from use of the Clips (104) and Snap Tab Holes (124) with Snap Tab Protrusions (128).

D). An advantage of the present invention is to provide such a device that is inexpensive to buy and inexpensive to manufacture.

This comes from use of the Clips (104), Snap Tab Holes (124) with Snap Tab Protrusions (128), and Control Cord Hole Free Window Blind Slats (156) which are very close technologies to prior art horizontal window blinds in terms of materials used, methods of manufacture, skill of manufacture, and training for use.

E). An advantage of the present invention is to provide such a device in the form of a clip (104) and also an edge cover strip which can be of whatever color or pattern is necessary to properly blend with the existing window blinds and the room interior.

This is accomplished by the use of the Clips (104), Snap Tab Holes (124) with Snap Tab Protrusions (128), Control Cord Hole Free Window Blind Slats (156), and the Left Edge Cover Strip (140) and the Right Edge Cover Strip (144).

F). An advantage of the present invention is to allow the clip (104) to be of different colors to match the window blind color.

This is accomplished by the use of the Clips (104) and Snap Tab Holes (124) with Snap Tab Protrusions (128).

G). An advantage of the present invention is to provide a decorator item where the clip (104) and edge cover strips can serve to accent the solid blind color, the clip (104) and edge cover strips can have cartoon characters to decorate children's bedrooms, the clip (104) and edge cover strips can have a person's name or family crest, and other decorative or accent uses.

This is accomplished by the use of the Clips (104) with Snap Tab Holes (124) and Snap Tab Protrusions (128), Control Cord Hole Free Window Blind Slats (156), and the Left Edge Cover Strip (140) and the Right Edge Cover Strip (144).

H). An advantage of the present invention is to provide such a device that allows the edge cover strip to be easily removed for cleaning or altering colors of the edge cover strip.

This results from use of the Left Edge Cover Strip (140) and the Right Edge Cover Strip (144) attached with Positive Hook and Loop Fastener Pads (148) and Negative Hook and Loop Fastener Pads (152).

I). An advantage of the present invention is to provide such a device that is easily removable in its entirety for cleaning or dusting of the window frame or the blind.

This results from the Peeping Tom Deterrent Design for Horizontal Window Blinds of the Present Invention (100) being entirely removable from the Window Casing Top (908) by the use of prior art snap open and snap shut attachment holders usually made of metal which are screwed into the wall or window frame.

J). An advantage of the present invention is to provide such a device that does not interfere in any way with the tilt closing (minimal light leaks), tilt opening and raising open (minimal stack height) or lowering close of the fully tilt opened blinds.

Especially important is full tilt opening and tilt closing in both directions of front slat edge up and down when viewing the blind from inside of a room. This object has not been met by prior art high privacy blind designs. Also relevant in this regard is the amount of light leaks in a fully lowered shut and tilt close operation. Many prior art high privacy designs introduce too many light leaks, thus, making them impractical and not commercially viable. The objective of low light leaks is obvious for the benefit of sleeping persons and people wishing high privacy in bedrooms and bathrooms.

Especially important is full raise open/lower close operation. The object is to minimize "stack height" or the vertical height of the stacked slats after a full raise open operation. This objective has not been met by many prior art high privacy blind designs. The objective of minimized "stack height" is obvious for allowing maximum air flow, maximized unobstructed outside or street view, and light entry when the user wishes such conditions such as on the first warm day of spring after a long, dark, and cold winter.

Especially important is no or very little increase in the reaction time and effort for raise open/lower close operation and tilt open/tilt close operation in either tilt direction. Many prior art high privacy designs have caused a large increase in reaction time and effort leading to commercial infeasibility due to inconvenience.

This is achieved by use of the Clip (104) with Front Loop (108) and Rear Loop (116), Control Cord Hole Free Window Blind Slat (156), Window Blind Raising Open and Lowering Close Control Cord Pair (160) and Window Blind Tilt Control Cord Pair (164).

K). An advantage of the present invention is that it provides an edge device that prevents Peeping Toms (916) from gazing through the gaps created at the ends of the window blinds in those installations where the window blinds are recessed within a window casing.

This results from use of the Left Edge Cover Strip (140) and the Right Edge Cover Strip (144)

L). An advantage of the present invention is that it provides such a clip device (104) that detachably fastens about the cord hole free, window blind slats in such a manner that a bent or damaged Control Cord Hole Free Window Blind Slat (156) can be removed or replaced. Children and dogs often bend and dent aluminum, blind slats resulting in poor operation and unsightly gaps when tilt closed or lowered close. Replacement of individual slats is a desirable feature.

This is accomplished by the use of the Clips (104) with Snap Tab Holes (124) and Snap Tab Protrusions (128), and the Control Cord Hole Free Window Blind Slats (156).

M). An advantage of the present invention is that it provides a plurality of such clip devices (104) which are detachably fastened to a corresponding plurality of cord hole free, window blind slats, such clip devices (104) being vertically aligned to receive two pairs of control cords, an attached tilt operation pair of control cords and a "free play" raising and lowering pair of control cords.

This is described in DETAILED DESCRIPTION OF THE OPERATION OF THE PREFERRED EMBODIMENT, FIG. 3.

N). An advantage of this invention is that it has no necessity for tilt open and tilt close control cord ladder rungs which look like the steps upon a rope ladder of prior art horizontal window blinds. The slats rest upon the horizontal steps in prior art blinds.

This is accomplished by the Clips (104).

O). An advantage of the present invention is that it provides duplicated sets of such clip devices (104) which can be used with similar operation for each of the multiple vertical control cord columns across a blind. A small blind will have at least two sets of vertical control cord columns and a wide blind will have up to five sets of vertical control cord columns.

This is described in DETAILED DESCRIPTION OF THE OPERATION OF THE PREFERRED EMBODIMENT, FIG. 3.

P). An advantage of the present invention is that it provides such clip devices (104) with loops that are shaped to receive two pairs of control cords, the tilt control cord pair and the raising and lowering control cord pair. Such control cords must be retained in an untwisted and untangled position throughout the operations of tilt open/tilt close, full and partial raising open/lowering close.

This is described in DETAILED DESCRIPTION–OPERATION Of THE PREFERRED EMBODIMENT, see FIG. 3.

Q). An advantage of the present invention is to provide a device which can be sold at the retail or discount store with slats of different lengths custom cut and sold separately as components from the frame with integrated control cord mechanisms. This will allow at the store custom length cutting of the slats for retrofit upon an adjustable length frame. The object is to avoid the current need for a two week turn-around time on factory ordered, custom manufactured horizontal window blinds.

This is accomplished by the use of the Clips (104) with Snap Tab Holes (124) and Snap Tab Protrusions 128), and the Control Cord Hole Free Window Blind Slats (156).

DETAILED DRAWING DESCRIPTION, DETAILED OPERATION, AND ADVANTAGES OF ADDITIONAL EMBODIMENTS

In a 1st alternative embodiment (not shown in any Figures), the Control Cord Hole Free Window Blind Slat (156) has no cord holes, but, a slight top and bottom, rectangular shaped, notch is added with width equal to the width of the attached Clip (104) plus width tolerance and depth equal to the "non-flush" edge of the Clip (104) plus depth tolerance in order to fully minimize "light leaks" in a fully lowered closed and tilt closed blind. "Light leaks" are caused by non-flush Slat (156) edges in a fully lowered close and tilt closed blind. The minimization of "light leaks" is done by keeping the overlapping Slat (156) edges perfectly flush with each other by eliminating any protrusions or irregularities in the "straight edge" of the Slat (156) especially when the Clip (104) is attached. The exact factory machining of the mechanical tolerances of the Slat (156) and the Clip (104) to within 0.001 inches will prevent re-introducing a Peeping Tom peering hole or new "light leaks". Excessive "light leaks" from overlapped, non-flush Clip (104) edges is a major failing in most prior art, cordhole free, horizontal window blind designs.

In a 2nd Alternative Embodiment (not shown in any FIGS), the Rear Loop (116) is omitted from the device and the Window Blind Raising Open and Lowering Close Control Cord Pair (160) is not passed "free play" through the rear of the Clip (104), but, only passed "free play" through the Front Loop (108). The Window Blind Tilt Control Cord Pair (164) is knotted to the rear of the Clip (104) and also knotted using the Window Blind Tilt Control Cord Pair Knot (196) attaching it to the Front Loop (108).

DETAILED DRAWING DESCRIPTION, DETAILED OPERATION, AND ADVANTAGES OF ALTERNATIVE EMBODIMENTS

It will be understood that each of the elements described above, or two or more together may also find a useful application in other types of devices differing from the type described above.

Summary, Ramifications, and Scope

A). This invention allows a design in approach to high privacy horizontal window blinds which does not compromise in any way the operation of the device.

B). This invention allows a device which prevents a Peeping Tom (916) from gazing through the control cord holes in the slats of typical window blinds.

C). This invention allows a device which provides a design-in approach to high privacy and anti-Peeping Tom technology available upon newly factory built horizontal window blinds, which can be installed at the dwelling without the use of special tools or expertise.

D). This invention provides a device that is inexpensive to buy and inexpensive to manufacture.

E). This invention presents a device which is in the form of a clip (104) and also an edge cover strip which can be of whatever color or pattern is necessary to properly blend with the existing window blinds and the room interior.

F). This invention allows the clip (104) to be of different colors to match the window blind color.

G). This invention provides a decorative item where the clip (104) and edge cover strips can serve to accent the solid blind color, the clip (104) and edge cover strips can have cartoon characters to decorate children's bedrooms, the clip (104) and edge cover strips can have a person's name or family crest, and other decorative or accent uses.

H). This invention provides a device that allows the edge cover strip to be easily removed for cleaning or altering colors of the edge cover strip.

I). This invention provides a device that is easily removable in its entirety for cleaning or dusting of the window frame or the blind.

J). This invention provides a device such that the device does not interfere in any way with the tilt closing (minimal light leaks), tilt opening and raising open (minimal stack height) or lowering close of the fully tilt opened blinds.

K). This invention provides an edge device that prevents Peeping Toms (916) from gazing through the gaps created at the ends of the window blinds in those installations where the window blinds are recessed within a window casing.

L). This invention provides a clip device that detachably fastens about the cord hole free, window blind slats in such a manner that a bent or damaged Control Cord Hole Free Window Blind Slat (156) can be removed or replaced.

M. This invention provides a plurality of such clip devices (104) which are detachably fastened to a corresponding plurality of cord hole free, window blind slats, such clip devices (104) being vertically aligned to receive one pair of raise open and lower close, "free play" control cords, and one pair of attached tilt open and tilt close control cords.

N). This invention has no necessity for tilt open and tilt close control cord ladder rungs which look like the steps upon a rope ladder of prior art horizontal window blinds. The slats rest upon the horizontal steps in prior art blinds.

O). This invention provides duplicated sets of such clip devices (104) which can be used with similar operation for each of the multiple vertical control cord columns across a blind.

P). This invention provides a clip device (104) with loops that are shaped to receive two pairs of control cords, the tilt control cord pair and the raise open and lower close control cord pair.

Q). This invention provides a device which can be sold at the retail or discount store in components with slats of different lengths custom cut and sold separately from the frame integrated with control cord mechanisms.

The present invention overcomes the shortcomings of the prior art by providing an economical, easily installable, easily removable, newly factory built blind device which eliminates the need for slat control cord holes through which Peeping Toms (916) can peek, and positions a separate decorative, edge cover strip over any side gaps in a window casing. When the window blind is recessed within a window casing, complementary edge cover strips are provided which, when properly affixed proximate the window casing sides, prevent the Peeping Tom (916) from gazing through the gap created between the ends of the window blind slats and the window casing sides. The cord hole free slats when fully tilt closed and lowered closed, prevent the Peeping Tom (916) from viewing through the cord holes in a prior art horizontal window blind.

Many different alternative embodiments can be thought of by a skilled craftsman having all knowledge of the prior art and knowledge of the defined embodiments in this patent. For example, the clips (104) can be made of different materials such as metal, plastic, or aluminum. The clips (104) can be of different shapes or sizes. The clips (104) can have different types of closure mechanisms. The edge cover strips can be of different materials such as vinyl, cloth, nylon, or plastic. The edge cover strips can be of different colors to match the room interior. The edge cover strips can be of different patterns if desired such as animated cartoon characters as a designer item for children's bedrooms. The edge cover strips can be of different widths. The slat tilt close and tilt open and slat raising and lowering mechanism can be of a different design.

Without further analysis, the foregoing description will so fully reveal the mechanism of the present invention that others of average skill in the prior art and knowledge of all prior art can adapt it for different applications meeting the claims of said invention.

Although the description above contains many specifications, these should not be construed as limiting the scope of the invention but as merely providing illustrations of some of the presently preferred embodiments of this invention.

I claim:

1. A device for a horizontal window blind of the type installed over the interior of common household windows which invention comprises the following elements:

a) a set of control cords,
  1) a raising open and lowering close control cord,
  2) a tilt open and tilt close control cord, b) a window blind head rail, c) a window blind bottom board, d) a window blind raising and lowering mechanism, e) a window blind tilt open and tilt close mechanism, f) a set of cord hole free slats,
  1) a single slat having absolutely no control cord holes,
  2) a single slat curved upwards with means to minimize light leaks by keeping a top edge of the slat flush when in contact with the adjoining upper slat when in a tilt close up operation, and respectively, a bottom edge of the slat flush when in contact with the adjoining bottom slat when in a tilt close down operation, g) a clip, the clip having:
  1) a first portion and a second portion, the first and second portions each having a first and second end, the first and second portion first ends being joined, the first and second portion second ends being detachably fastenable about one of the slats, the second portion second end further having a rear loop, the rear loop being sized to receive the set of control cords, such that the tilt control cord is tied to the rear loop and the raising and lowering control cord runs freely through the rear loop,
  2) a front loop, the front loop being attached proximate the joinder of the first and second portion first ends, the front loop being shaped to receive the set of control cords such that, the tilt control cord is tied to the front loop and the raising and lowering control cord runs freely through the front loop, in which the clip is used as means to connect the cord hole free slats to the control cords and the control cords are connected at the top to the window blind head rail and at the bottom to the window blind bottom board and furthermore, the control cords are connected to a window blind raising and lowering mechanism and a window blind tilt open and tilt close mechanism.

2. The improvement of claim 1, wherein a plurality of the clips are fastened to a plurality of the slats, the clips being more or less vertically aligned.

3. The improvement of claim 1, wherein the front loop is shaped to retain the control cords in an untwisted and untangled position.

4. The improvement of claim 1, wherein the rear loop is shaped to retain the control cords in an untwisted and untangled position.

5. The improvement of claim 1, wherein the raise open and lower close control cords are pulley attached proximate the top of the window blinds, are threaded free play down through one or more of the clips' front loops, are attached to the bottom board, are threaded free play back up through one or more of the clips' rear loops, and are again pulley attached proximate the top of the window blinds.

6. The improvement of claim 1, wherein the window blind slats have left and right ends and the window blinds are positioned within a window casing having a top, bottom, left side and right side, such that a left and right gap is created between the window blind slats' left and right ends and the window casing left and right sides, respectively, the improvement further comprising a pair of complementary edge vision block members, the complementary edge vision block members being of sufficient width that, when attached proximate the window casing left side and right side, the left gap and the right gap are covered.

* * * * *